United States Patent [19]

Mandelbaum

[11] Patent Number: 4,842,131

[45] Date of Patent: Jun. 27, 1989

[54] COMBINATION DISPLAY STRUCTURE AND SHIPPING CARTON FOR NECKTIES OR THE LIKE

[75] Inventor: Andrew M. Mandelbaum, Beverly Hills, Calif.

[73] Assignee: Superba, Inc., Los Angeles, Calif.

[21] Appl. No.: 225,861

[22] Filed: Jul. 28, 1988

[51] Int. Cl.[4] ..... B65D 5/32

[52] U.S. Cl. ..... 206/45.15; 206/45.3; 206/279; 206/285; 206/297; 211/59.1

[58] Field of Search ..... 206/44 R, 45.14, 45.15, 206/45.28, 45.3, 278, 279, 280, 284, 285, 289–292, 296–299; 211/49.1, 54.1, 57.1, 59.1

[56] References Cited

U.S. PATENT DOCUMENTS

| | | | |
|---|---|---|---|
| 1,682,046 | 8/1928 | Johnson | 206/280 |
| 1,682,273 | 8/1928 | Fuller | 206/284 |
| 2,163,116 | 6/1939 | Derman | 206/280 |
| 2,659,643 | 11/1953 | Friesz | 206/292 |
| 3,003,617 | 10/1961 | Field et al. | 206/279 |
| 3,265,216 | 8/1966 | Samsing | 211/57.1 |
| 3,357,542 | 12/1967 | Aquino et al. | 206/279 |
| 3,565,242 | 2/1971 | Konkoli | 206/292 |
| 3,978,593 | 9/1976 | Pulitzer et al. | 211/59.1 |
| 4,671,417 | 6/1987 | O'Brien | 211/59.1 |
| 4,779,720 | 10/1988 | Mandelbaum | 206/285 |

*Primary Examiner*—Jimmy G. Foster
*Attorney, Agent, or Firm*—Harvey S. Hertz

[57] ABSTRACT

An improved combination shipping and display structure for neckties or the like. A generally rectangular, open-faced inner carton includes an assembly of tie hanger rods supported from an assembly of supporting horizontal and vertical rods. The assembly of the supporting rods is supported within the inner carton by hinged flaps which are part of the carton side walls and fold inward to secure the assembly of supporting rods into the carton against the back panel thereof. The top of the inner carton folds backward and includes a flap affording an advertising panel and a tongue retained between the carton back panel and a top horizontal rod member in the display mode. The retainer assembly has a back panel formed as one piece with vertical baffles held in slots in inwardly bent portions of the retainer back panel. The inner carton with retainer assembly in place are inserted into a conventional outer carton for shipping.

14 Claims, 3 Drawing Sheets

COMBINATION DISPLAY STRUCTURE AND SHIPPING CARTON FOR NECKTIES OR THE LIKE

BACKGROUND OF THE INVENTION

This invention relates generally to carton structures serving as combined shipping containers and display racks and, more specifically, to such carton structures for neckties or similar articles.

Combination shipping and display containers have been fabricated in various forms for transport and subsequent display of various articles without the necessity for transferring the articles from one container to another. Usually, such containers or cartons are "fold-ups" from a die-cut flat cardboard blank, and are fabricated to display a particular article. Such a prior art arrangement is disclosed in U.S. Pat. No. 4,579,220. In that container, the articles displayed are placed in a partitioned tray. No particular structure is otherwise provided for limiting the shifting around of the articles when the container is folded closed for shipment and the degree of security against shipping damage is minimal, i.e. is provided only by the walls of the display counter themselves.

Other display cartons such as that of U.S. Pat. No. 3,168,192 are directed toward prevention of pilfering and are said to be adapted for shipping. However, additional wrapping or containment would likely be required. Again, articles displayed are in a partitioned tray.

U.S. Pat. No. 4,201,291 is a carton adapted for non-sag mounting on a wall or bulkhead and is adapted to fold closed for shipping.

Yet another display carton which protects the merchandise contained when it is in the closed mode, as for shipping, and displays it in a tilted forward manner when open, is shown in U.S. Pat. No. 2,730,232.

None of the aforementioned prior art is adapted for shipping of neckties with appropriate protection although U.S. Pat. Nos. 2,608,292 and 416,502 contemplate necktie display without significant shipping protection.

A copending application with common inventorship, vis-a-vis this application is U.S. patent application Ser. No. 033,229, filed Apr. 2, 1987, now U.S. Pat. No. 4,779,720, entitled "Combination Display Structure and Shipping Carton, Especially for Neckties and the Like." This application discloses improvement in the invention disclosed in that prior application.

The requirements for protection of a shipment of neckties are unique. The ties must be prevented from ruffling during transport and be provided sufficient protection from damage which could result from rough handling of the shipping carton. Of course, tight packing in fitted boxes or tray compartments can afford protection. However, the ties must be unpacked and separately displayed otherwise in that case.

The manner in which the invention responds to the disadvantages of the prior art and contributes importantly to the art will be understood as this specification proceeds.

SUMMARY

It may be said to have been the general object of the invention to provide an effective, inexpensive and easily assembled combination shipping and display carton, particularly for neckties and the like.

The combination according to the invention includes an open-faced inner (display) carton of generally rectangular character and a plurality of spaced outwardly projecting hanger bars over which the ties are hung. A separate retainer assembly having separating baffles arranged to fit between the suspended ties is inserted in to the inner carton after ties are emplaced over the hanger bars. A planar flap and tongue, which are extended portions of the rear wall of the inner carton, are folded over the top and the viewing opening of the inner carton for shipping. An outer carton is then provided into which the inner carton is inserted to form a fully protected shipping container.

The aforementioned flap and tongue are doubled back into a generally vertical form providing an advertising panel held in place by insertion of the tongue behind the hanger support structure when the inner carton and its contents are displayed.

A pair of mounting hooks affixed to rotate outward from the inner carton structure provide for mounting on a wall or other generally vertical structure for display.

The improvements disclosed comprise formation of slotted vertical spacer support members within the panel of the retainer assembly by folding that panel to form inwardly projecting, generally horizontal projections with slots for friction gripping of the vertical spacers which affords improved and low cost assembly. A folded flap and fastener arrangement locks a support structure to the carton structure.

The details of a typical embodiment according to the invention are presented hereinafter.

BRIEF DESCRIPTION OF THE DRAWINGS

FIG. 3 is a view of the inner carton with the tongue inserted behind the tie bar supporting structure to provide a vertical or sloped panel for advertising, pricing data, or the like.

DETAILED DESCRIPTION

Figure 1:
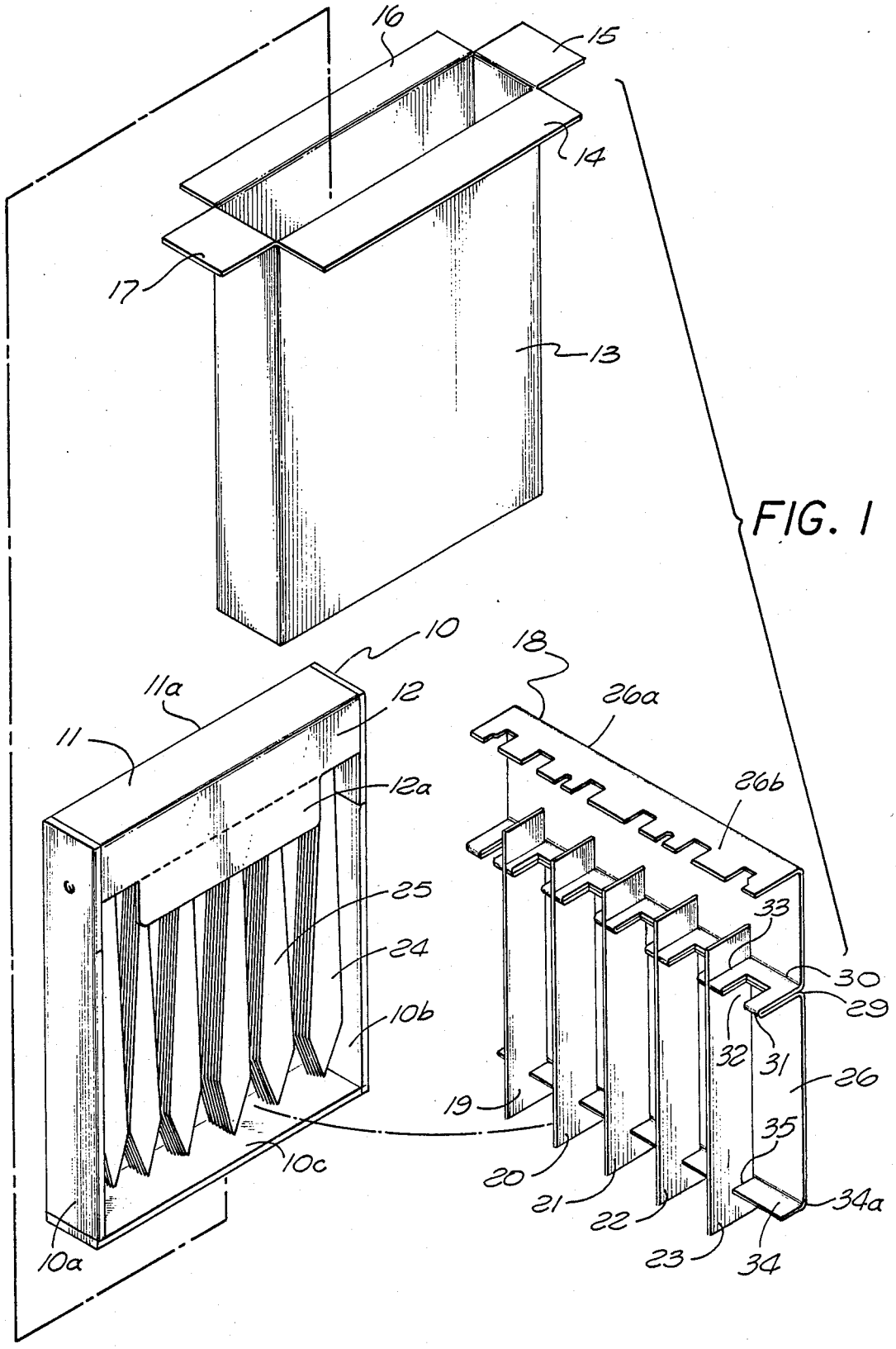
FIG. 1 is an exploded view of the assembly according to the invention showing inner carton, retainer assembly and outer carton members.

Referring now to FIG. 1, an inner carton is seen at 10 with top 11, flap 12 and tongue 13 in place for insertion into outer carton 13 for shipment. Outer carton 13 has conventional foldover portions 14, 15, 16 and 17, facilitating closure of the outer carton as is well known in the box art.

The inner carton comprises top 11 hinged about edge 11*a*, sides 10*a* and 10*b* and bottom 10*c* as illustrated.

The retainer assembly 18 fits into the display opening (aperture) of inner carton 10 such that the generally vertical baffles, 19, 20, 21, 22 and 23 fit between columns of ties represented typically at 24 and 25. The retainer assembly panel 26 then forms a closure for the open face of inner carton 10 and flap 12 and tongue 12*a* fold downward over retainer assembly 18 for insertion into outer carton 13 for shipping.

The retainer assembly 18 is preferably fabricated from a flat panel and is die-cut in a flat pattern and bent to form the upper multiple U-shaped orthogonally and horizontally extending portions, typically 27 and 28. Those bends are made along the edges 29, 30 and 31. A plurality of U-shaped slots (apertures) such as 32 are thereby formed. Each column of ties is thereby retained in upper apertures 32 and between adjacent vertical baffles such as 22 and 23 (typically).

The bending of panel 26 and 29, 30 and 31 avoids the need for other means for anchoring the aforementioned vertical baffles. The narrower slots, such as at 33, provide a friction grip on the vertical baffles (23 typically). Since the fold at 31 etc. is not a break in the unfolded panel 26, the latter may be die-cut in its flat form to provide all slots when the panel is formed as shown in FIG. 1.

Baffles 22, 23, etc. serve to prevent lateral displacement of the columns of ties, and the vertical location of the folds at 29 and 30 may be selected to accommodate neckwear of a variety of types.

The retainer assembly 18 is basically expendable once it has served its purpose during shipping.

The inner and outer cartons and the retainer assembly 18 are readily fabricated from cardboard of a grade well known in the box and carton art.

Lower folds of panel 26 as at 34*a* provide friction baffle gripping slots at 35, etc. The lateral spacing between vertical baffles may thereby by optimum and not limited by any other structure at the lower end of the retainer assembly 18. Thus columns of neckties (24 and 25, etc.) may be close-spaced laterally thereby maximizing the number of neckties which may be packed in a given sized inner carton.

An upper orthogonal fold of panel 26 at 26*a* affords a lip 26*b* which includes a pattern of slots as shown, these accommodating extension of the vertical baffles or tie knots in the event that ties are alternatively shipped in knotted form for display in that form.

It will be seen that the retainer assembly 18 fits within the inner carton 10, the panel 26 providing closure thereof.

Figure 2:
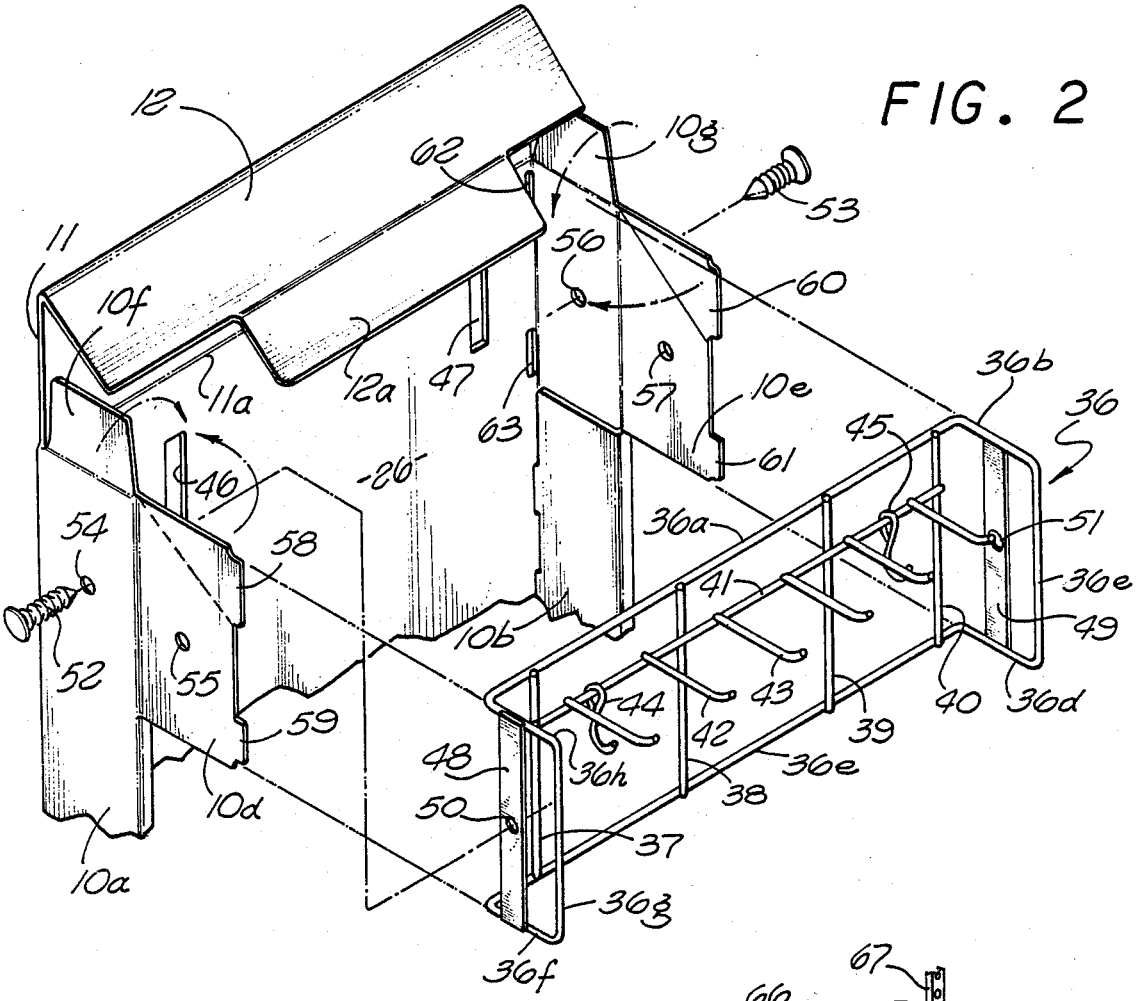
FIG. 2 is an exploded pictorial view of the inner carton of the assembly with flap and tongue portions partly raised and illustrating how the hanger bar supporting structure (framework) is assembled into the inner carton.

Referring now to FIG. 2, an exploded view of the inner carton and the hanger support structure 36, is presented. The hanger support structure 36 is in the shape of an outward facing U, with portions 36*a*, 36*b*, 36*c*, 36*d*, 36*e*, 36*f*, 36*g* and 36 as shown. Vertical spacer rods, typically 37, 38, 39 and 40, are affixed between 36*a* and 36*e* as shown to provide a degree of structural rigidity since the hanger rod structure 36*h* is fabricated from rod stock (or wire) of nominal diameter.

A plurality of vertical rod members 37, 38, 39 and 40 serve to provide structural rigidity to the assembly 36.

Figure 7:
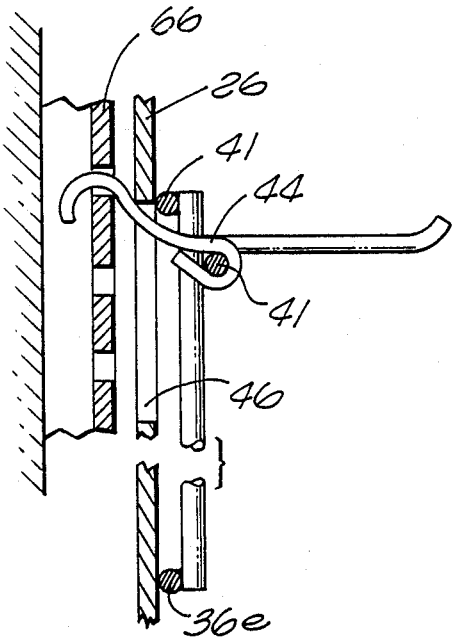
FIG. 7 is a sectional detail showing a mounting hook rearwardly and outwardly rotated for inner carton display mounting substantially vertically.

The horizontal member 41, and the projecting hanger rods, of which 42 and 43 are typical, are affixed to the other structural members of support structure 36 by means of welding, brazing or a similar known process. The connections among all the other aforementioned members of structure (framework) 36 as shown are accomplished by the same process. Rotatable hooks 44 and 45 facilitate wall mounting of the inner carton 10 when they are rotated to project through slots 46 and 47. This will be subsequently further described in connection with FIGS. 4 and 7.

Strips 48 and 49 having central holes 50 and 51, respectively, are affixed as shown, between 36*h* and 36*f* and 36*b* and 36*d*, respectively.

The entire assembly 36 may be fabricated from metallic rod or wire stock as assumed in the foregoing description or may be molded in essentially a single piece from a suitable known plastic material. In either case, the assembly 36 may be painted or otherwise coated to improve the display appearance.

Figure 5:
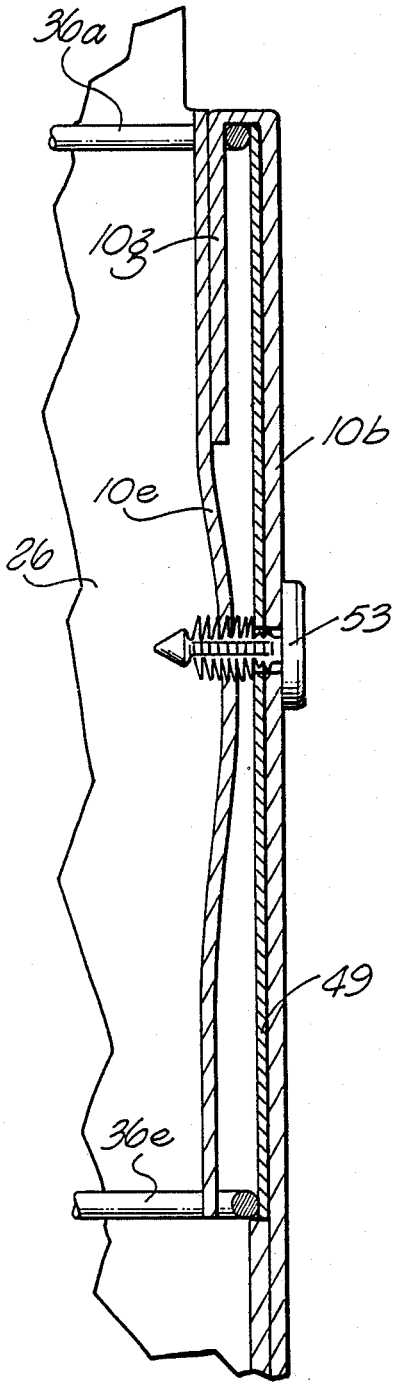
FIG. 5 is a sectional view taken from FIG. 4 to illustrate securing of side and orthogonal flaps of the carton sidewalls to anchor the hanger bar supporting structure.
Figure 6:
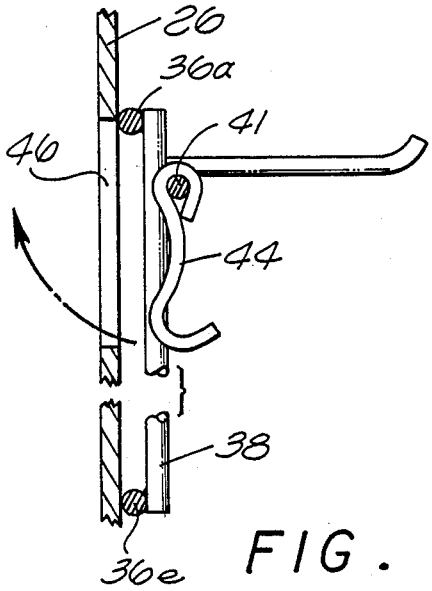
FIG. 6 is a sectional detail of the mounting hook arrangement in its retracted position for shipping.

Looking ahead to FIG. 5, considered with FIG. 2 to describe the installation of assembly 36 into the inner carton 10, it will be seen that members 36*a* and 36*e* will rest adjacent to the back panel 26. The side panels 10*a* and 10*b* of inner carton 10 have lateral and top flaps 10*d* and 10*f* (for side panel 10*a*) and 10*e* and 10*g* (for side panel 10*b*). With assembly 36 in place within the inner carton 10, flaps 10*f* and 10*g* are next folded downward over 36*h* and 36*b*, respectively. Then flaps 10*d* and 10*e* are folded inward and against the folded flaps 10*f* and 10*g*, respectively. Ears 60 and 61 are forced into slots 62 and 63, respectively in back panel 26. Similarly, ears 58 and 59 are forced into corresponding slots in back panel 26. Although the slots for ears 58 and 59 are not visible in FIG. 2, it is to be understood that their location corresponds to slots 62 and 63 along the laterally opposite edge of back panel 26. Finally, fasteners 52 and 53 are inserted. Holes 54, 55 and 50 (in strip 48) are now aligned, as are holes 56, 57 and 51. Insertion of fasteners 52 and 53 serves to lock the corresponding parts described hereinabove together. Fasteners 52 and 53 are commonly called "Christmas tree" fasteners because of their shape.

Figure 3:
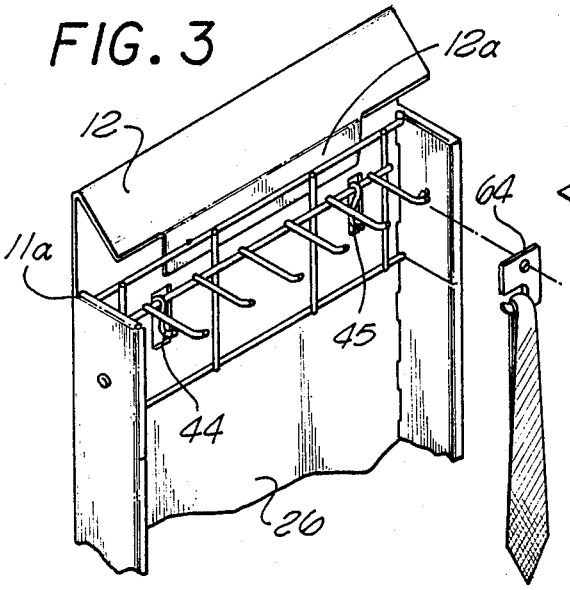
Figure 4:
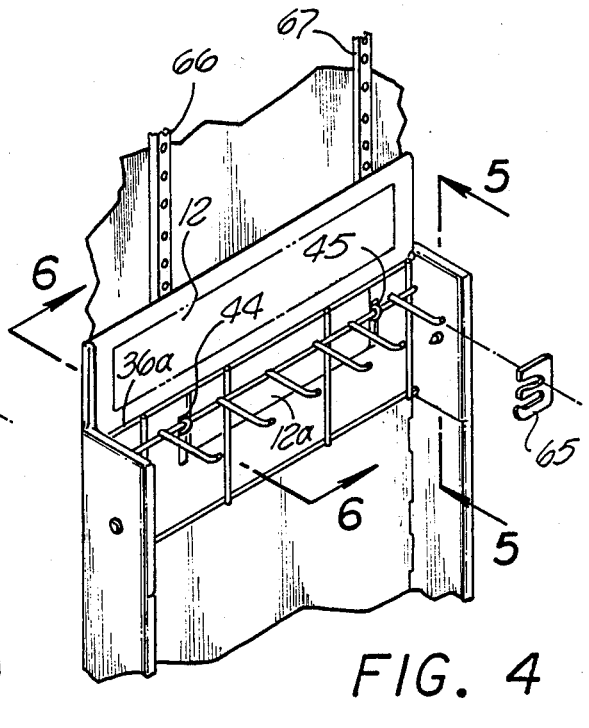
FIG. 4 is a detail of the wall-mounted carton with vertically oriented advertising panel with alternative planar hooks shown.

FIG. 3 illustrates the assembly produced in accordance with the described sequence, the tongue 12*a* being partially inserted between member 36*a* and back panel 26. FIG. 4 shows tongue 12*a* fully inserted and panel 12 in the normal vertical plane for display. Planar clips (tie hangers) 64 and 65 are of alternate types common in this art. In FIG. 4, the hooks 44 and 45 have been rotated from the FIG. 3 position to extend through slots 46 and 47 respectively so that they can engage vertical wall strips 66 and 67. This engagement is shown in the sectional view of FIG. 7 which is largely self-explanatory.

Various modifications of the described structure, within the scope of the invention, will occur to the skilled reader. For example, the strips 48 and 49 could be located to bear against the back panel 26 outside of the lateral width of tongue 12*a*. In that case additional fasteners would be required, and the flaps 10*f*, 10*d*, 10*g* and 10*e* would serve to lock the other assembly 36 members in place in the same way as described.

In lieu of hooks 44 and 45, another type of fastener could be used. Still further, pre-installed, rigid, wall-mounted, upward-turned hooks could be employed and the assembly of the invention could be placed over these alternative hooks projecting through slots 46 and 47 in back panel 26 to grip member 41 of the assembly 36.

Materials for implementation of the invention are those common in the art. No special materials, tolerances or manufacturing methods are required.

The term top as used in connection with the carton assembly refers to its top when mounted according to FIG. 4.

It is not intended that the scope of the invention should be considered limited to the embodiment illustrated or described, these being intended as typical and illustrative only.

I claim:

1. A combination shipping and display carton assembly for neckties or the like, comprising:

a generally rectangular open-faced first carton having a back panel opposite said open face, two side panels and a top panel hinged at its joint with said back panel;

a pair of first flaps attached to and extending upward, one from each of the tops of said side panels;

a pair of second flaps extending laterally outward one from the top end of each of said side panels;

a generally, outwardly, U-shaped framework for supporting a plurality of hanger bars to extend generally perpendicularly outward with respect to said back and within said inner carton, said framework including lateral sections nesting against said side panels adjacent the top of said inner carton, said first flaps being folded substantially 180 degrees downward over corresponding lateral sections of said framework and said second flaps being folded substantially 180 degrees inwardly over said first flaps;

and fastener means for joining each of said second flaps to the corresponding side panel.

2. The combination according to claim 1 including a hole through each of said side panels and a congruent hole through each of the corresponding second flaps is provided and said fasteners pass through said holes to join said second flaps to said corresponding side panels.

3. The combination according to claim 2 in which said fasteners are Christmas tree fasteners applied through said side panels to engage said second flaps.

4. The combination set forth in claim 3 further including a message panel hinged to said top panel at its joint with said back panel and a tongue comprising an extension of said message panel inserted downward between said back panel and the top horizontal member of said framework for holding said message panel in substantially vertical orientation.

5. The combination according to claim 2 in which said framework includes an ancillary structural member associated with each of said framework lateral sections, said ancillary members each including a hole congruent with the corresponding holes through said second flaps and corresponding side panels when said framework is in place, said fastener means comprising a Christmas tree fastener inserted from the outside of each of said side panels through said corresponding ancillary structural member hole and congruent second flap hole.

6. The combination according to claim 1 in which said fasteners are Christmas tree fasteners.

7. The combination according to claim 1 in which said framework includes an ancillary structural member associated with each of said framework lateral sections, said ancillary members each including a hole congruent with the corresponding holes through said second flaps and corresponding side panels when said framework is in place, said fastener means comprising a Christmas tree fastener inserted from the outside of each of said side panels through said corresponding ancillary structural member hole and congruent second flap hole.

8. The combination set forth in claim 7 further including a message panel hinged to said top panel at its joint with said back panel and a tongue comprising an extension of said message panel inserted downward between said back panel and the top horizontal member of said framework for holding said message panel in substantially vertical orientation.

9. The combination according to claim 1 in which said fasteners are Christmas tree fasteners applied through said side panels to engage said second flaps.

10. A combination shipping and display carton assembly for neckties or the like comprising:

a generally rectangular open-faced carton having a back panel opposite said open face, two side panels and a top panel hinged at its joint with said back panel;

a framework anchored to the interior of said carton adjacent its top for providing a plurality of laterally spaced hanger rods for hanging a corresponding plurality of neckties or the like;

a retainer assembly inserted into said open face of said carton, said retainer assembly comprising a closure panel which fits into said carton open face to provide closure of said carton, said retainer assembly including a spaced plurality of generally vertically mounted baffles for providing lateral separation of columns of neckties hanging from said spaced hanger rods, said baffles being generally planar and mounted perpendicular to said closure panel;

means for mounting said baffles comprising a first 90 degree inward fold of said closure panel along a laterally extending line, a subsequent 180 degree outward fold of said closure panel and a second 90 degree fold of said closure panel into the unfolded plane of said closure panel thereby producing a double thickness inwardly extending rib having an inward dimension not exceeding the inside depth of said carton;

and means comprising a pattern of U-shaped slots into said rib, said slot alternately being of narrow width to friction grip said baffles placed therein and wider width to laterally contain said neckties at the location of relatively narrow necktie column width.

11. The combination according to claim 10 in which said framework is U-shaped outward, having lateral portions adjacent the inside surfaces of said side panels adjacent said carton top, and in which said side panels include at least a lateral flap extending from back of said side panels, said flaps being folded substantially 180 degrees to bear against said framework lateral portions, and means are included for anchoring said flaps to said side panels.

12. The combination according to claim 11 in which said means for anchoring said flaps includes a Christmas tree fastener through holes in each of said flaps and the corresponding side panel.

13. The combination according to claim 11 in which said frameworks lateral portions each include an auxiliary structural member in which a hole is provided in alignment with said holes in said flaps and side panels and said fastener passes through said structural member hole as well as through said corresponding flap and side panel.

14. The combination according to claim 13 in which said fasteners are Christmas tree fasteners.

* * * * *